United States Patent [19]

Larson

[11] Patent Number: 4,702,887

[45] Date of Patent: Oct. 27, 1987

[54] CORROSION RESISTANT CASTING ALLOY FOR WEAR

[75] Inventor: John A. Larson, Easton, Pa.

[73] Assignee: Ingersoll-Rand Company, Woodcliff Lake, N.J.

[21] Appl. No.: 833,556

[22] Filed: Feb. 27, 1986

[51] Int. Cl.[4] ..... C22C 19/05

[52] U.S. Cl. ..... 420/442; 420/445; 420/450; 420/451; 420/453

[58] Field of Search ..... 420/453, 442, 445, 450, 420/451; 148/427, 428

[56] References Cited

U.S. PATENT DOCUMENTS 2,743,176 4/1956 Thomas et al. ..... 420/453

*Primary Examiner*—R. Dean

*Attorney, Agent, or Firm*—Walter C. Vliet

[57] ABSTRACT

A corrosion and wear resistant nickel based alloy having unique high molybdenum content with additions of bismuth and tin or bismuth, tin and antimony dispersed as second phase particles. The resulting alloy is particularly suited for wear ring applications in pumps for corrosive fluids.

7 Claims, 1 Drawing Figure

(a) Prior Art (b) Alloy Type I (c) Alloy Type II

CORROSION RESISTANT CASTING ALLOY FOR WEAR

BACKGROUND OF THE INVENTION

In the design and construction of various types of machinery, closely fitted rotating parts are often found which must run together or slide past one another without galling or experiencing unacceptable wear. In many cases, materials such as the lead-tin babbits can be selected and when coupled with a suitable lubricant, low frictional forces and low rates of wear are attainable. When the lubricant layer is sufficiently thick and maintained to prevent material contact, a state of hydrodynamic lubrication exists. When the film is not sufficient to keep the mating materials completely separated and some contact occurs, boundary lubrication exists.

In many cases, it is not possible to select "bearing" type materials for mating parts, and the use of suitable lubricants is not possible. One of the most common types of machinery in this category is pumps. Most centrifugal type pumps, which contain rotating impellers, require close tolerances (0.010 inch to 0.020 inch diametrical clearance) between the impeller hub and the casing to prevent leakage which can decrease the efficiency. During transient periods, such as starting and stopping, there can be contact between the impeller and the casing, particularly in multistage pumps where some deflection of the shaft occurs at rest. Unfortunately, these parts sliding past one another must depend upon the lubricating ability of whatever fluid is being pumped. In many cases, these fluids are not good lubricants.

The most common technique employed to prevent galling and unacceptable wear of these components is the use of impeller and casing wear rings, where "compatible" materials are selected. For example, one can use a material like cast iron, where the graphite flakes act as a built-in lubricant. Another technique is to harden materials so that there is at least a 50 Brinell hardness spread between the parts or to harden both components above 400 Brinell, where the hardness differential is not required. Obviously, this technique of hardening will only work on materials which can be hardened, such as steels having sufficient carbon, or with coatings. However, the corrosiveness of many fluids, such as seawater or brines containing hydrogen sulfide, precludes the use of hardenable materials and in many cases, coatings. Unfortunately, most corrosion resistant materials, such as the austenitic stainless steels and the nickel based alloys, have very poor wear characteristics and will gall if contact occurs. Although it is possible to improve the wear characteristics of some of these corrosion resistance materials with weld overlays, the process is expensive and in some cases the corrosion resistance of the base material can be destroyed.

It is therefore an object of this invention to provide a corrosion and wear resistant alloy which exhibits the combination of corrosion and wear resistance to an extent not heretofor obtainable in commercial alloys of reasonable cost.

This and other objects are obtained in corrosion and wear resistant alloy comprising the following anticipated ranges of critical elements:

| | C | Mn | Si | P | S | Cr | Mo | Fe | Al | Ti | Bi | Sn | Sb | Ni |
|---|---|---|---|---|---|---|---|---|---|---|---|---|---|---|
| % MIN. | — | — | — | — | — | 20.0 | 6.0 | — | — | — | 2.0 | 2.0 | 1.0 | — |
| % MAX. | 0.08 | 1.0 | 1.0 | 0.03 | 0.03 | 25.0 | 10.0 | 5.0 | 0.4 | 0.4 | 5.0 | 5.0 | 3.0 | Balance |

BRIEF DESCRIPTION OF THE ILLUSTRATION

FIG. 1 shows a comparison of the results of a standard ASTM G48 corrosion test comparing the prior art alloy and two versions of the present invention.

DESCRIPTION OF THE PREFERRED EMBODIMENT

Figure 1:
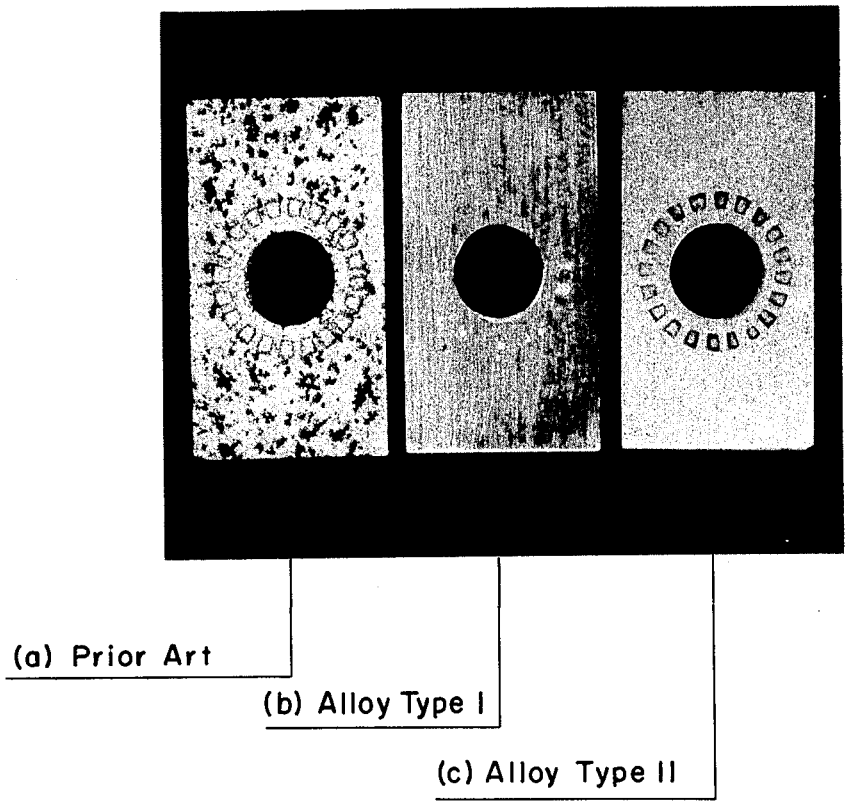

A practical method of solving the wear problems of corrosion resistant materials is to improve the wear characteristics using metals such as bismuth, tin and antimony, which exhibit little or no solid solubility and can thus be dispersed as second phase particles. An alloy using tin and bismuth and a method of manufacture is shown in U.S. Pat. No. 2,743,176 (1956) by Ralph W. Thomas and Warren C. Williams. Although this material has been used successfully as wear rings in pump applications, it does not have sufficient corrosion resistance for many pump applications involving oil field brines and the like. The material described by Thomas has insufficient chrome and molybdenum to provide the required degree of corrosion resistance when the fluid has a high chloride content or when a combination of chlorides and hydrogen sulfide exists which usually produces a low pH.

In the alloy according to this invention, it has been found that substantially higher than suggested molybdenum additions in the chemistry of a corrosion resistant base material to which controlled amounts of bismuth and tin or bismuth, tin and antimony have been added, produce a material which has exceptional wear characteristics. Two variations of the alloy, one without antimony (Type I) and one with antimony (Type II), have been produced and tested. The chemical compositions are as follows:

CHEMICAL COMPOSITION

The chemical composition of the new alloy according to the present invention has an anticipated range of the following percentages of critical elements:

| | C | Mn | Si | P | S | Cr | Mo | Fe | Al | Ti | Bi | Sn | Sb | Ni |
|---|---|---|---|---|---|---|---|---|---|---|---|---|---|---|
| | | | | | | Type I | | | | | | | | |
| % MIN. | — | — | — | — | — | 20.0 | 8.0 | — | — | — | 2.0 | 2.0 | | — |
| % MAX. | 0.03 | 1.0 | 0.4 | 0.03 | 0.03 | 23.0 | 10.0 | 5.0 | 0.4 | 0.4 | 5.0 | 5.0 | | Balance |
| | | | | | | Type II | | | | | | | | |
| % MIN. | — | — | — | — | — | 20.0 | 8.0 | — | — | — | 2.0 | 2.0 | 1.0 | |
| % MAX. | 0.03 | 1.0 | 0.4 | 0.03 | 0.03 | 23.0 | 10.0 | 5.0 | 0.4 | 0.4 | 4.0 | 5.0 | 3.0 | Balance |

The alloy has a preferred range of critical elements of:

| | C | Mn | Si | P | S | Cr | Mo | Fe | Al | Ti | Bi | Sn | Sb | Ni |
|---|---|---|---|---|---|---|---|---|---|---|---|---|---|---|
| | | | | | | Type I | | | | | | | | |
| % MIN. | 0.01 | 0.2 | 0.2 | — | — | 20.5 | 8.5 | — | — | — | 3.0 | 3.0 | | |
| % MAX. | 0.03 | 1.0 | 0.4 | 0.03 | 0.03 | 22.5 | 9.5 | 5.0 | 0.1 | 0.1 | 4.0 | 4.0 | | Balance |
| | | | | | | Type II | | | | | | | | |
| % MIN. | 0.01 | 0.2 | 0.2 | — | — | 20.5 | 8.5 | — | — | — | 2.5 | 3.0 | 1.5 | |
| % MAX. | 0.03 | 1.0 | 0.4 | 0.03 | 0.03 | 22.5 | 9.5 | 5.0 | 0.1 | 0.1 | 3.5 | 4.0 | 2.5 | Balance |

The alloy has a specific composition of critical elements as follows:

| C | Mn | Si | P | S | Cr | Mo | Fe | Al | Ti | Bi | Sn | Sb | Ni |
|---|---|---|---|---|---|---|---|---|---|---|---|---|---|
| | | | | | | Type I | | | | | | | |
| 0.02 | 0.4 | 0.3 | 0.02 | 0.02 | 21.0 | 9.0 | 3.0 | 0.2 | 0.2 | 3.5 | 3.5 | | Balance |
| | | | | | | Type II | | | | | | | |
| 0.02 | 0.4 | 0.3 | 0.02 | 0.02 | 21.0 | 9.0 | 3.0 | 0.2 | 0.2 | 3.0 | 3.5 | 2.0 | Balance |

MECHANICAL PROPERTIES

The following results are typical properties obtained from centrifugally cast hollow bars using a standard 0.357 inch diameter tensile bar machined and tested in accordance with ASTM E8.

| Alloy | Ultimate Tensile Strength psi | 0.2% Yield Strength psi | Elongation Percent | Reduction of Area Percent | Hardness |
|---|---|---|---|---|---|
| Type I | 72,000 | 61,000 | 6 | 4.5 | Rb 98 |
| Type II | 62,000 | 59,000 | 4.5 | 3.5 | Rb 96 |

LOCALIZED CORROSION RESISTANCE

FIG. I shows the results of a 5 day immersion test in 6% $FeCl_3$ (10% $FeCl_3.6H_2O$) prepared according to ASTM G48. This test uses a multiple crevice assembly according to ASTM G78 and is a measure of the susceptibility to localized corrosion (crevice and pitting corrosion). It has been shown that results from this test correlate well with tests in aerated seawater. In this particular test, the sample was 2 inches long, $1\frac{1}{8}$ inches wide and $\frac{1}{4}$ inch thick and was clamped between two plastic delrin serrated washers using a torque of 4.5 Nm. The serrations on the plastic washer produced 20 crevice sites on each side, and the susceptibility to crevice corrosion is a function of the degree (both area and depth) of corrosion under the serrations. In addition, the susceptibility to pitting type corrosion is given by pits which develop on the exposed surface. FIG. 1 clearly shows the superiority of the alloy described in this invention over the alloy described by Thomas in the prior art. Although the Type II alloy does shown some crevice corrosion, it is only a thin surface type stain. The Type I alloy is essentially free of both crevice corrosion and pitting corrosion. The alloy described by Thomas shows both severe crevice corrosion and pitting corrosion.

Since localized corrosion is one of the primary causes of pump wear ring failures, particularly in fluids used for secondary oil recovery, the alloy described in this invention has wide applications.

WEAR CHARACTERISTICS

To determine the wear characteristics of the alloy described in this invention, labratory tests were run using equipment and procedures described in ASTM G77. The equipment utilized was the Faville-LeValley LW-1Friction and Wear Test Machine which uses a stationary block sliding on a rotating ring. The test procedure utilized has been developed to simulate pump transient conditions of starting and stopping. The procedure involves starting under load, increasing the sliding speed to the desired level in 1 minute, holding at this speed for $2\frac{1}{2}$ minutes and then decreasing the speed to zero in $\frac{1}{2}$ minute. This procedure has been used to evalute many combinations of materials and has been shown to correlate well with actual pump field results.

The tests utilized a sliding velocity of 50 ft./sec. and a load of 50 psi. From a graphical recording of the frictional force, the static coefficient can be obtained and from the weight loss of the ring and block, the dimensionless wear factor, can be calculated according to E. Rabinowicz, "Wear Coeffients-Metals", *Wear Control Handbook,* Edited by M. B. Peterson and W. O. Winer, American Society of Mechanical Engineers, New York, 1980, pgs. 475–506. As Rabinowicz shows, the wear factor is given by:

$$K = WH/FVT$$

Where

W = Volume of material worn away
H = DPH hardness of material worn
F = Applied load
V = Velocity
T = Time This factor can be used to compare the wear characteristics of material couples and thus rank materials. The lower this number, the better the wear characteristics. The following table shows the results of these tests:

| Alloy Couple | Weight Loss mg./min. | Coefficient of Friction Statis | Coefficient of Friction Dynamic | Wear Factor |
|---|---|---|---|---|
| (1) Ring-IR 885[a] Block-Prior Art | Ring-4.23 Block-20.0 | 0.72 | Hydro. | $1.88 \times 10^{-4}$ |
| (2) Ring-IR 885 Block-Type I | Ring-3.70 Block-0.98 | 0.47 | Hydro. | $1.35 \times 10^{-4}$ |
| (3) Ring-IR 885 | Ring-5.38 | 0.64 | Hydro. | $1.48 \times 10^{-4}$ |

-continued

| Alloy Couple | Weight Loss mg./min. | Coefficient of Friction Statis | Coefficient of Friction Dynamic | Wear Factor |
|---|---|---|---|---|
| Block-Type II | Block-3.80 | | | |

Above tests conducted with a load of 50 psi and a sliding speed of 50 feet/second.
[a]A patented Ingersoll-Rand stainless steel alloy used for corrosive applications.

These results show that both Type I and Type II alloys perform better than the prior art alloy described by Thomas, since the static coefficients of friction are lower and the wear factors are lower. In addition, based on the weight loss of the blocks, it appears that the Type I and Type II alloys will experience less wear during transient conditions and therefore will last longer as wear ring materials.

I claim:

1. A nickel based corrosion and wear resistant alloy consisting of the following range of chemistry:

| | C | Mn | Si | P | S | Cr | Mo | Fe | Al | Ti | Bi | Sn | Sb | Ni |
|---|---|---|---|---|---|---|---|---|---|---|---|---|---|---|
| % MIN. | — | — | — | — | — | 20.0 | 6.0 | — | — | — | 2.0 | 2.0 | 1.0 | — |
| % MAX. | 0.08 | 1.0 | 1.0 | 0.03 | 0.03 | 25.0 | 10.0 | 5.0 | 0.4 | 0.4 | 5.0 | 5.0 | 3.0 | Balance |

2. A nickel based corrosion and wear resistant alloy consisting of the following range of chemistry:

| | C | Mn | Si | P | S | Cr | Mo | Fe | Al | Ti | Bi | Sn | Ni |
|---|---|---|---|---|---|---|---|---|---|---|---|---|---|
| % MIN. | — | — | — | — | — | 20.0 | 8.0 | — | — | — | 2.0 | 2.0 | — |
| % MAX. | 0.03 | 1.0 | 0.4 | 0.03 | 0.03 | 23.0 | 10.0 | 5.0 | 0.4 | 0.4 | 5.0 | 5.0 | Balance |

3. A nickel based corrossion and wear resistant alloy consisting of the following range of chemistry:

| | C | Mn | Si | P | S | Cr | Mo | Fe | Al | Ti | Bi | Sn | Sb | Ni |
|---|---|---|---|---|---|---|---|---|---|---|---|---|---|---|
| % MIN. | — | — | — | — | — | 20.0 | 8.0 | — | — | — | 2.0 | 2.0 | 1.0 | — |
| % MAX. | 0.03 | 1.0 | 0.4 | 0.03 | 0.03 | 23.0 | 10.0 | 5.0 | 0.4 | 0.4 | 4.0 | 5.0 | 3.0 | Balance |

4. A nickel based corrosion and wear resistant alloy consisting of the following range of chemistry:

| | C | Mn | Si | P | S | Cr | Mo | Fe | Al | Ti | Bi | Sn | Ni |
|---|---|---|---|---|---|---|---|---|---|---|---|---|---|
| % MIN. | 0.01 | 0.2 | 0.2 | — | — | 20.5 | 8.5 | — | — | — | 3.0 | 3.0 | — |
| % MAX. | 0.03 | 1.0 | 0.4 | 0.03 | 0.03 | 22.5 | 9.5 | 5.0 | 0.1 | 0.1 | 4.0 | 4.0 | Balance |

5. A nickel based corrosion and wear resistant alloy consisting of the following range of chemistry:

| | C | Mn | Si | P | S | Cr | Mo | Fe | Al | Ti | Bi | Sn | Sb | Ni |
|---|---|---|---|---|---|---|---|---|---|---|---|---|---|---|
| % MIN. | 0.01 | 0.2 | 0.2 | — | — | 20.5 | 8.5 | — | — | — | 2.5 | 3.0 | 1.5 | — |
| % MAX. | 0.03 | 1.0 | 0.4 | 0.03 | 0.03 | 22.5 | 9.5 | 5.0 | 0.1 | 0.1 | 3.5 | 4.0 | 2.5 | Balance |

6. A nickel based corrosion and wear resistant alloy consisting of the following composition:

| C | Mn | Si | P | S | Cr | Mo | Fe | Al | Ti | Bi | Sn | Ni |
|---|---|---|---|---|---|---|---|---|---|---|---|---|
| 0.02 | 0.4 | 0.3 | 0.02 | 0.02 | 21.0 | 9.0 | 3.0 | 0.2 | 0.2 | 3.5 | 3.5 | Balance |

7. A nickel based corrosion and wear resistant alloy consisting of the following composition:

| C | Mn | Si | P | S | Cr | Mo | Fe | Al | Ti | Bi | Sn | Sb | Ni |
|---|---|---|---|---|---|---|---|---|---|---|---|---|---|
| 0.02 | 0.4 | 0.3 | 0.02 | 0.02 | 21.0 | 9.0 | 3.0 | 0.2 | 0.2 | 3.0 | 3.5 | 2.0 | Balance |

* * * * *